US006140595A

United States Patent [19]

Yao

[11] Patent Number: 6,140,595

[45] Date of Patent: Oct. 31, 2000

[54] KEY SWITCH ARRANGEMENT

[75] Inventor: Huan-Ming Yao, Tao-Yuan, Taiwan

[73] Assignee: Hon Hai Precision Ind. Co., Ltd., Taipei Hsien, Taiwan

[21] Appl. No.: 09/394,992

[22] Filed: Sep. 13, 1999

[30] Foreign Application Priority Data

May 4, 1999 [TW] Taiwan ..... 88207018

[51] Int. Cl.[7] ..... H01H 3/12

[52] U.S. Cl. ..... 200/344; 200/341

[58] Field of Search ..... 200/341–344, 200/512–517

[56] References Cited

U.S. PATENT DOCUMENTS 5,457,297 10/1995 Chen ..... 200/344

5,878,872 3/1999 Tsai ..... 200/344

*Primary Examiner*—Michael L. Gellner
*Assistant Examiner*—Nhung Nguyen
*Attorney, Agent, or Firm*—Wei Te Chung

[57] ABSTRACT

A key switch arrangement comprises a key cap, a key switch subassembly pivotally mounted to a bottom surface of the key cap, a circuit membrane under the key switch subassembly and forming a switch electrode thereon, a rubber member disposed between the key switch subassembly and the circuit membrane and forming a rubber cone for triggering the switch electrode when the key cap is compressed by an external force, and a supporting plate defining an opening therein. Engaging means is insert molded into the opening of the supporting plate, and comprises a pair of first and second engaging arms for pivotally engaging with the key switch subassembly.

12 Claims, 3 Drawing Sheets

KEY SWITCH ARRANGEMENT

BACKGROUND OF THE INVENTION

The present invention relates to a key switch arrangement, and particularly to a key switch arrangement which can ensure an excellent operational performance.

Conventional key switch arrangements are disclosed in Taiwan Patent Application Nos. 83204123, 8121456, 84218262, 85202834, 85203.94, and U.S. Pat. Nos. 5,278,372; 5,278,374; 5,39,084; 5,399,822; 5,463,195; 5,278,371; and 5,504,283.

One kind of conventional key switch arrangement commonly comprises a key cap, a key switch subassembly slidably mounted to a bottom surface of the key cap for providing a switching effect, a key switch supporting plate having engaging portions for engaging with the key switch subassembly, a circuit membrane forming a switch electrode thereon, a rubber member mounted between the switch supporting plate and the circuit membrane for triggering the switch electrode of the membrane circuit, and a supporting plate attached under the circuit membrane for supporting the key switch arrangement. Such a conventional key switch arrangement has a significant height resulting a bulky key board.

In order to reduce the volume of a key board, another key switch arrangement has been introduced. Such a key switch arrangement commonly comprises a key cap, a key switch subassembly mounted to the key cap, a membrane circuit, a rubber member attached between the key switch subassembly and the circuit membrane for triggering the member circuit, and a supporting plate forming engaging portions thereon for engaging with the key switch subassembly and for supporting the entire key switch arrangement.

However, since the engaging portions of the supporting plate are usually integrally formed or stamped from the metal supporting plate, ragged edges are unavoidably formed on the engaging portions. The ragged edges adversely affect the operational continuity of the key switch assembly and may shorten the life-span of the key switch subassembly of the key board thereby increasing costs. In addition, since the supporting plate is made of resilient metal, the engaging portions are apt to deform during transport of components of the conventional key switch arrangement (including the supporting plate). When this happens, assembly of the key switch arrangement will become difficult.

Therefore, an improved key switch arrangement is required.

BRIEF SUMMARY OF THE INVENTION

A main object of the present invention is to provide a key switch arrangement which can ensure excellent operational performance and a reliable application.

Another object of the present invention is to provide a key switch arrangement which can reduce manufacturing costs and fulfill miniaturization requirements.

A key switch arrangement in accordance with the present invention comprises a dielectric key cap, a key switch subassembly mounted to a bottom surface of the key cap, a circuit membrane forming a circuit thereon for transmitting operational signals therethrough, a rubber member assembled between the key switch subassembly and the circuit membrane for triggering a switch electrode of the membrane circuit, and a supporting plate attached under the circuit membrane for supporting the key switch arrangement. Engaging means is insert molded into a tapered opening defined in the supporting plate for engaging with the key switch subassembly. The engaging means comprises a pair of first engaging arms, a pair of second engaging arms, and a pair of horizontal supporting pads abutting against a top surface of the supporting plate for retaining the engaging means within the opening of the supporting plate.

Other objects, advantages and novel features of the invention will become more apparent from the following detailed description when taken in conjunction with the accompanying drawings.

DETAILED DESCRIPTION OF THE INVENTION

Figure 1:
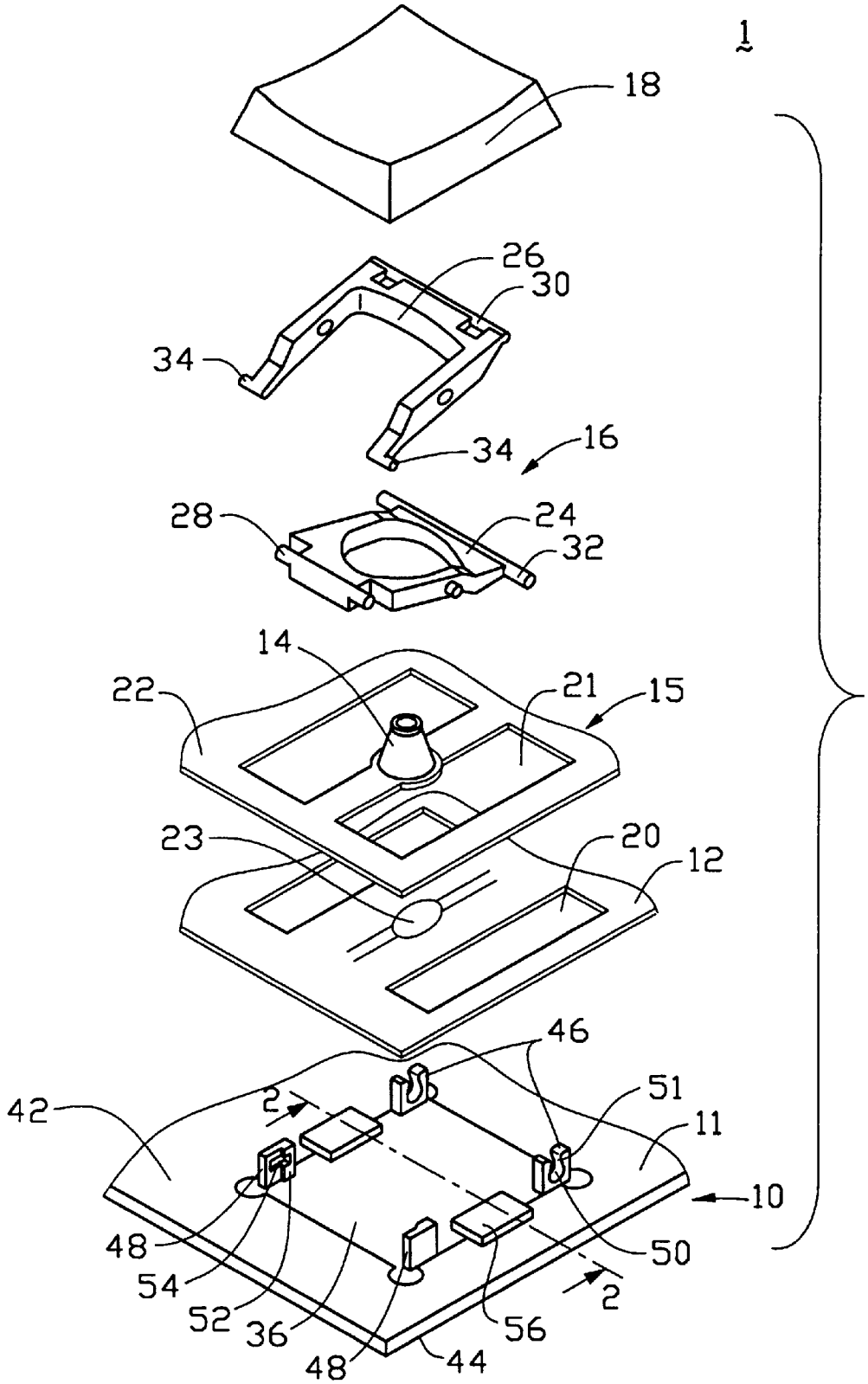
FIG. 1 is an exploded view of a key switch arrangement of the present invention.

Referring to FIG. 1, a key switch arrangement 1 in accordance with the present invention comprises a key cap 18, a key switch subassembly 16, a rubber member 15, a circuit membrane 12, and a module 10. The module 10 comprises a supporting plate 11 and a plastic engaging means 36 insert molded into an opening 38 (FIG. 3) of the supporting plate 11 for engaging with the key switch subassembly 16. The supporting plate 11 is mounted under the circuit membrane 12 for supporting the key switch arrangement 1. The key switch subassembly 16 is mounted to a bottom surface of the key cap 18. The rubber member 15 is assembled between the key switch subassembly 16 and the circuit membrane 12.

The key switch subassembly 16 comprises first and second members 24, 26 pivotally connected together. The first member 24 forms a shaft 32 for engaging with the engaging means 36, and a rod 28 opposite the shaft 32 for engaging with the key cap 18. The second member 26 forms a pair of studs 34 for engaging with the engaging means 36, and a pair of recesses 30 for engaging with the key cap 18.

The rubber member 15 comprises a planar sheet 22 defining a pair of apertures 21 for extension of the engaging means 36 therethrough, and a rubber cone 14 outwardly projecting from the planar sheet 22 between the two apertures 21. The circuit membrane 12 forms a printed circuit, a switch electrode 23 corresponding to the rubber cone 14 of the rubber member 15, and a pair of rectangular cavities 20 corresponding to the apertures 21 of the rubber member 15 for extension of the engaging means 36 therethrough.

Figure 2:
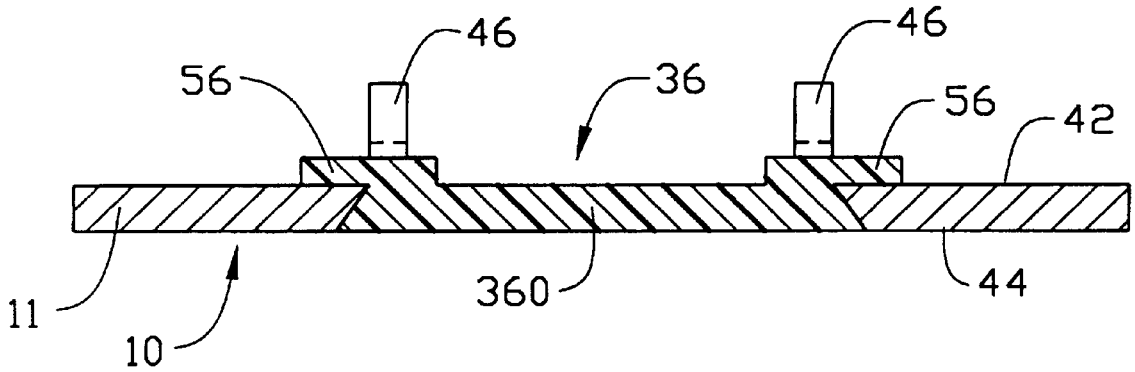
FIG. 2 is a cross-sectional view taken along line 2—2 of FIG. 1.
Figure 3:
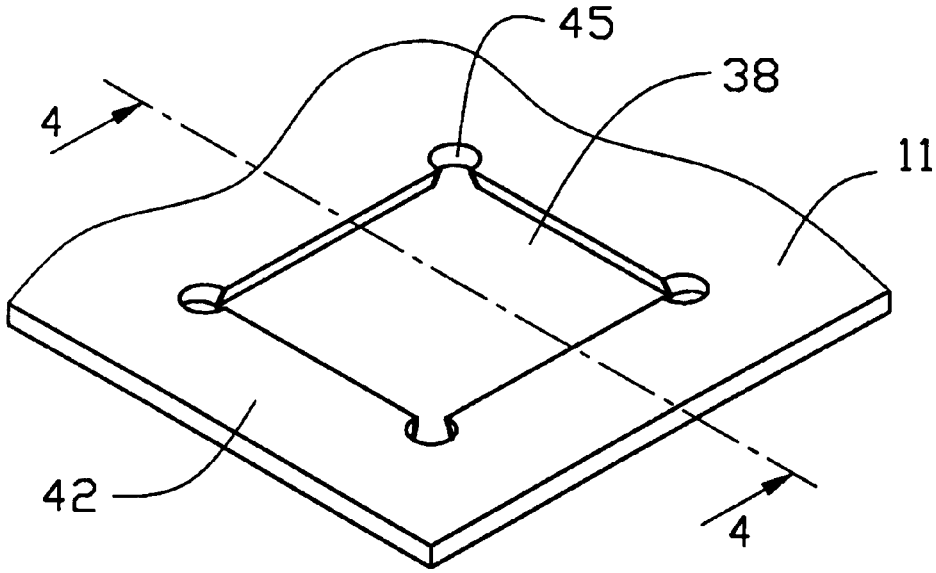
FIG. 3 is a partial, perspective view of a supporting plate of the key switch arrangement of FIG. 1.
Figure 4:
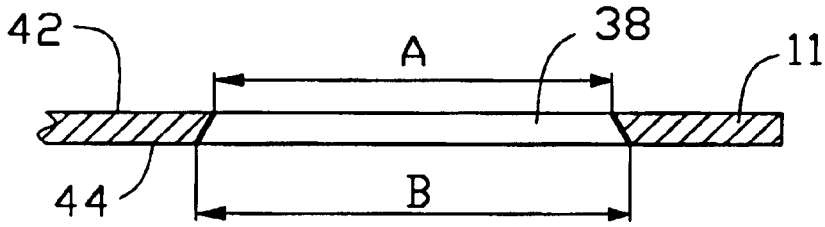
FIG. 4 is a cross-sectional view taken along line 4—4 of FIG. 3.

Referring further to FIGS. 2, 3 and 4, the supporting plate 11 is made of metal or other suitable material. The opening 38 is rectangular and communicates with a hole 45 formed at each corner thereof. The opening 38 has a smaller area "A" on a top face 42 of the supporting plate 11 and a larger area "B" on a bottom face 44 thereof thereby having a trapezoidal sectional configuration. The engaging means 36 forms a pair of horizontal pads 56 on opposite sides of the opening 38 on the top face 42 of the supporting plate 11. The pads 56 along with the trapezoidal sectional configuration of the opening 38 prevent the engaging means 36 from becoming disengaged from the supporting plate 11. In addition, the holes 45 receive overflow of molten plastic or other dielectric material thereby ensuring the formation of an even insert molded planar body 360 of the engaging means 36.

The engaging means 36 comprises a pair of first engaging arms 46 and a pair of second engaging arms 48 on opposite sides of the opening 38. Each horizontal pad 56 is located between the first and second engaging arms 46, 48. Each first engaging arm 46 defines a guiding opening 51 in a free end and exposed to an exterior thereof, and a latching aperture 50 in communication with the guiding opening 51 for pivotally engaging with opposite ends of the shaft 32 of the first member 24. Each second engaging arm 48 forms a stepped face 52 and defines a groove 54 in the stepped face 52 for pivotally receiving the corresponding engaging stud 34 of the second member 26.

In assembly, the circuit membrane 12 is firstly attached to the module 10. The first and second engaging arms 46, 48 are inserted through the corresponding rectangular cavities 20 of the circuit membrane 12. The rubber member 15 is then mounted onto the circuit membrane 12. The apertures 21 align with the corresponding rectangular cavities 20 of the circuit membrane 12 thereby allowing extension of the first and second engaging arms 46, 48 therethrough. The rubber cone 14 aligns with the switch electrode 23 of the circuit membrane 12.

The first and second members 24, 26 are pivotally connected together to form the key switch subassembly 16. The opposite ends of the shaft 32 of the first member 24 are forced to be pivotally received within the corresponding latching apertures 50 of the first engaging arms 46 via the guiding openings 51. The engaging studs 34 of the second member 26 are fitted into the grooves 54 of the corresponding second engaging arms 48.

The rod 28 of the first member 24 and the engaging recesses 30 of the second member 26 are then pivotally mounted to the bottom surface of the key cap 18. Thus, assembly of the key switch arrangement 1 is complete. When the key cap 18 is downwardly pressed by an external force, the key cap 18 will compress the key switch subassembly 16 and the rubber cone 14 to trigger the switch electrode 23 of the circuit membrane 12. A signal is thus transmitted via the circuit membrane 12.

The key cap 18, the key switch subassembly 16, the rubber member 15 and the circuit membrane 12, and the order of assembly thereof can be altered according to practical requirements. Furthermore, a keyboard mechanism usually comprises a plurality of the key switch arrangements. The rubber member 15 can thus comprise a plurality of rubber cones 14, while the circuit membrane 12 can include a plurality of switch electrodes 23 corresponding to the rubber cones 14 of the rubber member 15.

Since the engaging means 36 is insert molded into the supporting plate 11, the height occupied by the key switch arrangement 1 is effectively decreased. Furthermore, the engaging means 36 has a low friction with the key switch subassembly 16 compared with the conventional key arrangements since the engaging means 36 does not have any ragged edge which may be caused by stamping a metal plate. In addition, the horizontal pads 56 can provide the circuit membrane 12 as well as the entire key switch arrangement 1 with horizontal positioning effects. Finally, the engaging means 36 in accordance with the present invention will not easily deform; thus, it can precisely engage with the key switch subassembly 16 without any difficulty.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key switch arrangement comprising:

a key cap;

a key switch subassembly pivotally attached to a bottom of the key cap;

a circuit membrane mounted under the key switch subassembly and forming a switch electrode thereon;

a rubber member supported on the circuit membrane for triggering the switch electrode of the circuit membrane upon depression thereof; and a module comprising a supporting plate for supporting the circuit membrane, and an engaging means insert molded in the supporting plate and pivotally supporting the key switch subassembly.

2. The key switch arrangement as claimed in claim 1, wherein the supporting plate defines an opening, the engaging means being insert molded in the opening.

3. The key switch arrangement as claimed in claim 2, wherein the engaging means comprises a pair of first engaging arms and a pair of second engaging arms on opposite sides thereof for engaging with the key switch subassembly.

4. The key switch arrangement as claimed in claim 3, wherein each first engaging arm defines a guiding opening and a latching aperture in communication with the guiding opening for engaging with the key switch subassembly.

5. The key switch arrangement as claimed in claim 3, wherein each second engaging arm comprises a stepped face and a receiving groove for engaging with the key switch subassembly.

6. The key switch arrangement as claimed in claim 2, wherein the engaging means comprises a planar body insert molded within the opening of the supporting plate, and a pair of horizontal pads on opposite sides of the planar body for preventing the engaging means from disengaging from the supporting plate, the planar body of the engaging means and the opening of the supporting plate both having a trapezoidal sectional configuration for preventing the planar body from disengaging from the supporting plate.

7. The key switch arrangement as claimed in claim 1, wherein the key switch subassembly comprises a first member and a second member pivotally connected with the first member, the first member comprising a rod for pivotally engaging with the key cap and a shaft having a pair of free ends for pivotally engaging with the engaging means, the second member comprising a pair of engaging recesses for pivotally engaging with the key cap and a pair of engaging tabs for pivotally engaging with the engaging means.

8. A subassembly used in a key switch comprising:

a supporting plate comprising an opening having a trapezoidal sectional configuration; and an engaging means insert molded in the opening of the supporting plate and comprising a planar body insert molded in the opening, a pair of horizontal pads on opposite sides of the planar body, and a pair of first and second engaging arms formed adjacent to corresponding horizontal pads on opposite sides of the planar body, the planar body having a trapezoidal sectional configuration for complying with the opening to prevent the engaging means from disengaging from the supporting plate.

9. The subassembly as claimed in claim 8, wherein each first engaging arm defines a guiding opening and a latching aperture in communication with the guiding opening for engaging with a key switch subassembly.

10. The subassembly as claimed in claim 9, wherein each second arm forms a ladder face and defines a receiving groove for engaging with a key switch subassembly.

11. The subassembly as claimed in claim 8, wherein the pair of horizontal pads is for preventing the engaging means from disengaging from the supporting plate.

12. A key switch structure comprising:

a key cap;

a key switch subassembly pivotally attached to a bottom portion of the key cap;

a metal supporting plate defining an opening therein; and a plastic engaging means retainably received within said opening with a pair of first engaging arms and a pair of second engaging arms integrally formed on opposite sides thereof and upward extending above an upper surface of the supporting plate, wherein the key switch subassembly is pivotally attached to said pairs of first and second engaging arms.

* * * * *